US006827149B2

(12) United States Patent
Hache

(10) Patent No.: US 6,827,149 B2
(45) Date of Patent: Dec. 7, 2004

(54) METHOD AND APPARATUS FOR CONVEYING A TOOL IN A BOREHOLE

(75) Inventor: Jean-Michel Hache, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 79 days.

(21) Appl. No.: 10/206,477

(22) Filed: Jul. 26, 2002

(65) Prior Publication Data

US 2004/0016542 A1 Jan. 29, 2004

(51) Int. Cl.[7] ..... E21B 23/08

(52) U.S. Cl. ..... 166/381; 166/169; 166/241.5; 166/250.01; 166/254.2

(58) Field of Search ..... 166/77.1, 162, 166/169, 181, 222, 241.5, 250.01, 254.2, 381; 367/81–83, 86

(56) References Cited

U.S. PATENT DOCUMENTS

| | | | | |
|---|---|---|---|---|
| 4,860,581 A | | 8/1989 | Zimmerman et al. | |
| 4,936,139 A | | 6/1990 | Zimmerman et al. | |
| 4,937,446 A | | 6/1990 | McKeon et al. | |
| 5,237,540 A | | 8/1993 | Malone | |
| 5,249,161 A | | 9/1993 | Jones et al. | |
| 5,375,098 A | | 12/1994 | Malone et al. | |
| 6,170,573 B1 | * | 1/2001 | Brunet et al. | 166/153 |
| 6,179,055 B1 | | 1/2001 | Sallwasser et al. | |
| 6,182,765 B1 | * | 2/2001 | Kilgore | 166/381 |
| 6,191,588 B1 | | 2/2001 | Chen | |
| 6,516,663 B2 | * | 2/2003 | Wong | 73/152.52 |

OTHER PUBLICATIONS

Reeves Wireline Home Web Page—well logging solutions: "Compact Memory Logging (CML)" and "Compact Well Shuttle", 5–pp, printed Jul. 26, 2002.

* cited by examiner

*Primary Examiner*—Zakiya Walker
(74) *Attorney, Agent, or Firm*—Wayne I. Kanak; Robin Nava; Brigitte Echols

(57) ABSTRACT

A method for conveying a tool into a borehole with the use of a tool conveying apparatus includes deploying the tool conveying apparatus into the borehole, transmitting fluid through the tool conveying apparatus, the tool conveying apparatus generating power from the flow of fluid therethrough, discharging fluid from the tool conveying apparatus and providing power to at least one tool carried thereby. The tool conveying apparatus also includes a communication system for transmitting data bi-directionally between the tool and the surface.

26 Claims, 3 Drawing Sheets

METHOD AND APPARATUS FOR CONVEYING A TOOL IN A BOREHOLE

BACKGROUND OF THE INVENTION

1. Field of the Invention

The invention relates to methods, apparatus and systems for conveying a tool within a borehole. In several embodiments, for example, the invention relates to methods, apparatus and systems capable of deploying one or more tools within a non-vertical borehole without the necessity of power, or data, lines from the surface.

2. Description of Related Art

The deployment of tools in boreholes is well known. In the petroleum exploration and recovery industries, for example, tools are deployed in subsurface wells for a multitude of purposes, such as to conduct well logging and completion operations. The downhole use of tools in the petroleum exploration and recovery process is generally considered fundamental and essential.

Various challenges exist in delivering tools into boreholes. For example, the tool may require power from an external source for conducting its desired operations. For another example, it may be necessary to provide instructions to the tool when it is deployed in the borehole.

Numerous techniques and equipment have been used or proposed for delivering tools into boreholes. Again with reference to the petroleum exploration and recovery industries, for example, tools are often deployed in vertically-oriented wells with the use of a wireline that includes power and data cables extending from the surface. The wireline may also be deployed through coiled tubing or drill pipe to the tool. For another example, tool conveyance devices for propelling the tool along non-vertical or deviated wells have been proposed and used, such as the "tractor" technology disclosed in U.S. Pat. No. 6,179,055 B1, which is incorporated herein by reference.

In considering existing technology for conveying tools in boreholes, the present invention fulfills a need for methods, apparatus and/or systems having one or more of the following attributes: deploying tools into boreholes without the necessity of power lines extending from the surface; deploying tools into boreholes without the necessity of data transmission lines extending from the surface; deploying tools into boreholes without the necessity of wirelines extending from the surface; using an apparatus that carries one or more tools, the tools being rotatable while deployed in the borehole; allowing tools deployed in a borehole to be rotated, or moved in circular pattern, in the borehole; generating power in the borehole for powering at least one tool without the necessity of power lines from the surface; using fluid to generate power; using drilling mud to generate power; being deployable in a non-vertical borehole; providing cost effective delivery of tools into and within boreholes; providing speedy delivery of tools into and within boreholes; generating minimal friction during the delivery of tools into boreholes; using an easy to control and simple apparatus and technique for moving one or more tools into a borehole; reliable delivery of tools into boreholes; delivering tools in boreholes without the necessity of complex and/or cumbersome mechanical delivery equipment; providing any one or more of the above attributes with the use of existing equipment and technology and/or by retrofitting existing equipment.

BRIEF SUMMARY OF THE INVENTION

In accordance with the present invention, certain embodiments involve an apparatus useful for conveying a tool into a borehole from the surface without the necessity of power-delivery and communication lines from the surface. The apparatus is in fluid communication with a fluid source, is deployable in the borehole and includes a fluid delivery member and an interface system in fluid communication with the fluid delivery member. The interface system is designed to permit the deployment of standard, unmodified wireline tools and includes power generation and communication systems. A fluid discharge member is in fluid communication with the interface system and engageable with the tool(s). Fluid is provided to the power generation system through the fluid delivery member, utilized by the power generation system to generate power for powering a tool and discharged from the apparatus through the fluid discharge member. The communication system is capable of transmitting data between the surface and a tool without the necessity of data-delivery lines from the surface.

If desired, the fluid discharge member may be a circulating sub module having a fluid discharge port and being capable of electrically and electronically connecting the power generation system and a tool. The power generation system may include a turbo-alternator capable of generating electricity from the flow of fluid through the power generation system.

The fluid delivery member may be drill pipe that is controllably movable within the borehole so that the tool is controllably deployable in the borehole, or it may be coiled tubing. If desired, the fluid may be drilling mud and the borehole may be non-vertical or deviated. The fluid delivery member and/or the fluid discharge member may be integral with the power generation system.

In some embodiments, the power generation system includes a telemetry mud pulser/turbo-alternator module and a data acquisition/memory module. The mud pulser/turbo-alternator module may be capable of deriving power from the flow of fluid within the power generation system and transmitting power and data to the data acquisition/memory module. The mud pulser/turbo-alternator module and the data acquisition/memory module may include fluid flow passageways in fluid communication with one another. The mud pulser/turbo-alternator module may include a modulator and modulator controller, and may transmit data to the surface from the data acquisition/memory module. The data acquisition/memory module may transmit data between the mud pulser/turbo-alternator module and a tool.

Some embodiments involve a fluid discharge member that includes a discharge port, is connectable between the power generation system and a wireline telemetry sub, and is capable of electrically and electronically connecting the power generation system with a tool.

Various embodiments involve a tool conveying system useful for carrying a wireline tool and deploying the wireline tool in a non-vertical or deviated borehole from the surface. The tool conveying system includes a downhole power system and a fluid circulation system in fluid communication with one another. The fluid circulation system enables the flow of fluid through the downhole power system. The downhole power system is capable of generating power from the fluid flowing therethrough, providing power to a wireline tool carried by the tool conveying system, and communicating data between a wireline tool and the surface.

In such embodiments, the downhole power system may, if desired, be capable of generating electricity from the flow of fluid through the downhole power system without the use of power-delivery lines from the surface, and/or communicating data between a wireline tool and the surface without the use of a wireline from the surface. The downhole power system may include a telemetry mud pulser/turbo-alternator module and a data acquisition/memory module.

In certain embodiments, the present invention involves a method for conveying a tool into a borehole from the surface without the necessity of power-delivery and communication lines from the surface and with the use of a tool conveying apparatus deployable in the borehole. The method includes deploying the tool conveying apparatus in the borehole, transmitting fluid through the tool conveying apparatus, the tool conveying apparatus generating power from the flow of fluid therethrough and providing power to a tool carried thereby, and discharging fluid from the tool conveying apparatus.

If desired, the tool conveying apparatus may also transmit data between a tool carried thereby and the surface without the necessity of communication lines to the surface. Telemetry/mud pulser technology may be used to transmit data between a tool and the surface. The tool conveying apparatus may be deployable in the borehole by moving a rigid upper member of the apparatus.

The borehole may be non-vertical or deviated and the fluid may be drilling mud. A turbo-alternator may be included in the tool conveying apparatus that generates unregulated AC power from the fluid flow through the tool conveying apparatus. The tool conveying apparatus may be capable of transforming unregulated AC power to regulated AC and/or DC power. A data acquisition/memory module may be included in the apparatus that receives power and data, stores data and distributes power and data to a wireline tool.

Accordingly, the present invention includes features and advantages that enable it to advance the technology associated with conveying tools in boreholes. Characteristics and advantages of the present invention described above, as well as additional features and benefits, will be readily apparent to those skilled in the art upon consideration of the following detailed description of preferred embodiments and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF THE INVENTION

Figure 1:
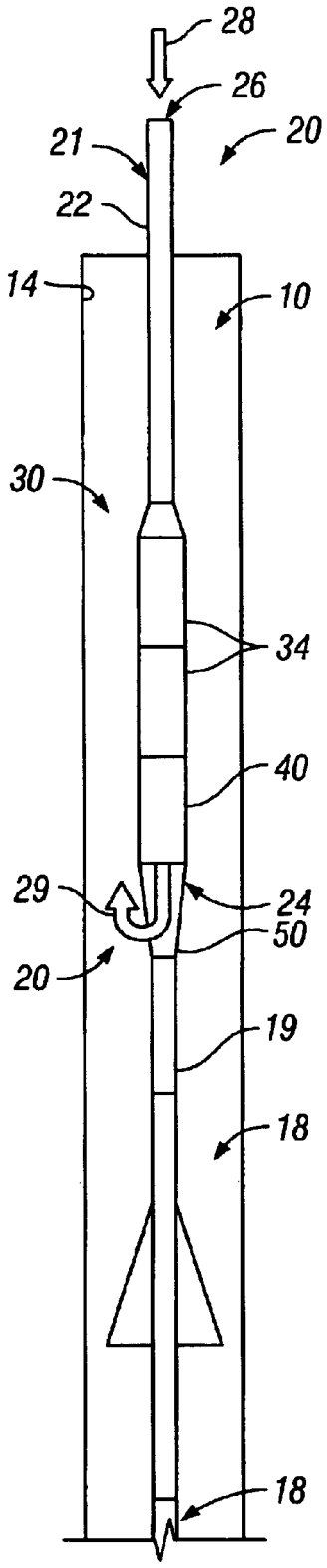
FIG. 1 is a schematic view of an embodiment of a tool conveying apparatus in accordance with the present invention, the tool conveying apparatus shown deployed in a borehole.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout the various portions of this specification, the terms "invention", "present invention", and variations thereof are not intended to mean the claimed invention of any particular of the appended claims, or all of the appended claims. These terms are used to merely provide a reference point for subject matter discussed in this specification. The subject or topic of each such reference is thus not necessarily part of, or required by, any particular claim (s) merely because of such reference. Accordingly, the use herein of the terms "invention", "present invention" and variations thereof is not intended and should not be used to limit the construction or scope of the appended claims.

Referring initially to FIG. 1, an example tool conveying apparatus 10 in accordance with the present invention is shown. The illustrated tool conveying apparatus 10 is capable of carrying and powering one or more tools 18 and, if desired, communicating data between the tool 18 and the surface (not shown), without the use of a wireline from the surface. Any suitable components and technique may be used in the apparatus 10 to provide such capabilities.

As used throughout this specification and in the appended claims and abstract, the terms "wireline tool", "tool", and variations thereof means one or more device or tool that can be used in a borehole. Some examples of tools which may be used with the present invention, methods of operation thereof, and techniques for communication therewith are described in U.S. Pat. Nos. 4,860,581; 4,936,139; 6,191,588 B1; and 4,937,446, each of which is incorporated herein by reference. However, the present invention is not limited in any way to the particular wireline tools or methods disclosed in the referenced patents, or otherwise by the type or operation of a tool that can be used with the present invention. Also as used throughout this specification and in the appended claims and abstract, the term "surface" and variations thereof means above-ground or thereabouts, or the operator(s) or equipment for operating or controlling the tool conveying apparatus, or another person, entity or equipment, wherever located, that is designated to operate or communicate with the tool conveying apparatus or wireline tool. The present invention is in no way limited by the nature or location of the "surface."

The exemplary tool conveying apparatus 10 is shown disposed within a borehole 14. As used throughout this specification and in the appended claims and abstract, the term "borehole" means any borehole, passageway or area suitable for use with the present invention. While the borehole 14 of FIG. 1 appears vertically-oriented, the present invention is not limited to any particular orientation of the borehole 14. For example, in a preferred embodiment, the tool conveying apparatus 10 is useful for conveying the tool 18 within a borehole 14 that is non-vertical, such as a "horizontal" or "deviated" well. Unless specifically indicated otherwise, the present invention is in no way limited by the type or orientation of borehole within which it is, or may be, used.

The tool conveying apparatus 10 of FIG. 1 includes a fluid circulation system 20 and a downhole interface system 30. The fluid circulation system 20 enables the flow of fluid through the downhole interface system 30, which utilizes the fluid to generate power, as will be described further below. As used herein, the term "fluid" means drilling mud or any other fluid or fluid/solid mixture suitable for use in accordance with the present invention. In preferred embodiments, the fluid is drilling mud, however, the present invention is not limited by the type of fluid that is, or may be, used.

The particular fluid circulation system 20 of FIG. 1 includes a fluid delivery member 21 and a fluid discharge member 24. In the illustrated embodiment, the fluid delivery member 21 is controllably movable, such as from the surface (not shown), to direct or control movement of the tool conveying apparatus 10 and attached tool 18 within the borehole 14. However, this capability is not required.

Still referring to the example of FIG. 1, the fluid delivery member 21 may be any suitable component(s) having any desired configuration, shape, and components as is or becomes known, such as drill pipe 22 or coiled tubing. The fluid delivery member 21 may be connectable with the downhole interface system 30 with the use of any suitable mechanical or other connection as is or becomes known. In some embodiments, the fluid delivery member 21 may instead be integral with the downhole interface system 30.

The fluid delivery member 21 includes at least one area, or passageway, 26 into which fluid may be provided, such as from the surface, as indicated by flow arrow 28. At least one such passageway 26 is in fluid communication with the downhole interface system 30. The fluid delivery member 21 thus allows the flow of, or directs, fluid into the downhole interface system 30.

Figure 3:
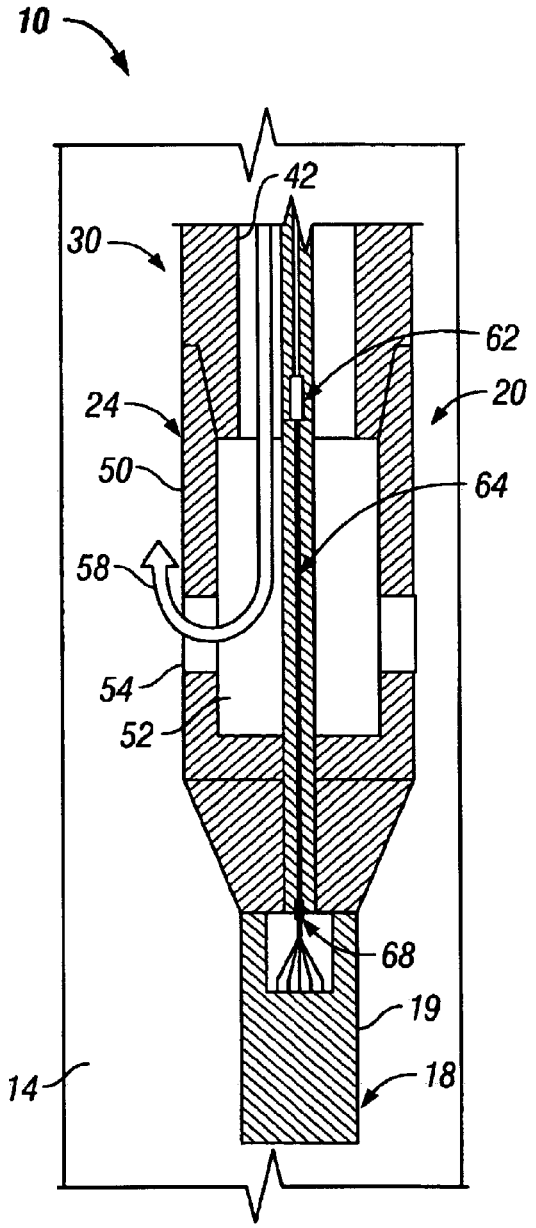
FIG. 3 is a partial cross-sectional view of an example circulating sub/interface module of the tool conveying apparatus shown in FIG. 1.

Still referring to FIG. 1, the exemplary fluid discharge member 24 enables ejection of the fluid from the downhole interface system 30, as indicated by flow arrow 29, and may be any suitable component(s) as is or become known. One particular embodiment of the fluid discharge member 24 is shown in FIG. 3, in which the fluid discharge member 24 is a circulating sub/interface module 50 connectable between the downhole interface system 30 and a wireline telemetry sub 19, such as via mechanical connections as is or become known. The illustrated circulating sub/interface module 50 includes at least one fluid passageway, or area, 52 in fluid communication with the downhole interface system 30, and at least one fluid ejection port 54 to allow the ejection of fluid (via fluid path 58) from the tool conveying apparatus 10 into the borehole 14. If desired, the fluid can be recirculated and reused as is, or becomes, known.

Still referring to FIG. 3, the illustrated circulating sub/interface module 50 also electrically and electronically connects the downhole interface system 30 and the tool 18 with connections 62, 68 and power/data wires 64 to allow power and data to be transmitted between the downhole interface system 30 and the tool 18, as is or becomes known. However, the present invention is not limited to the use of a circulating sub/interface module 50 or any of the details of the exemplary embodiment. For example, if desired, the fluid discharge member 24 may be integral with the downhole interface system 30. For another example, the fluid discharge member 24 may connect directly to the tool 18 without a telemetry sub 19.

Figure 2:
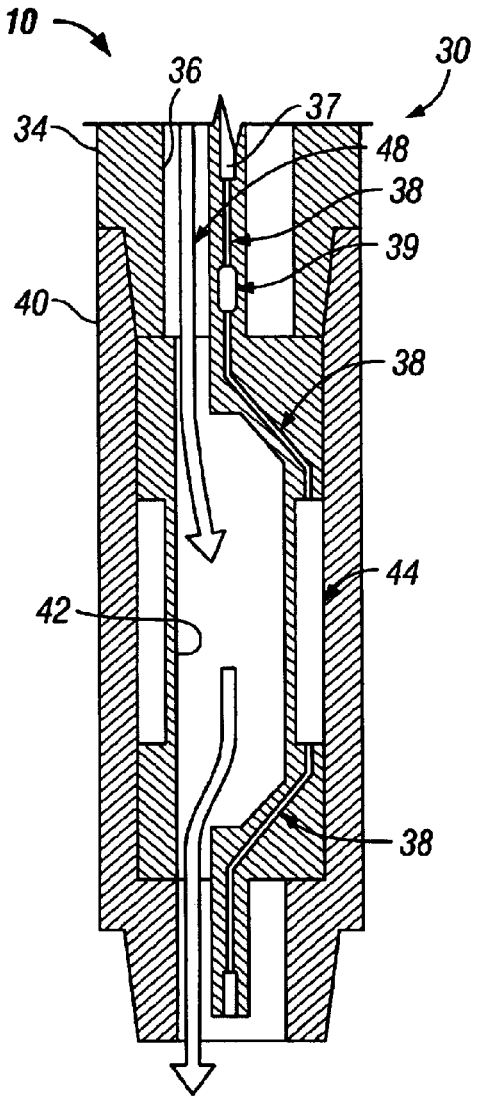
FIG. 2 is a partial cross-sectional view of an example data acquisition/memory module of the tool conveying apparatus shown in FIG. 1.

Referring back to FIG. 1, the downhole interface system 30 includes a power generation system that generates power from the fluid flowing through passageway 26, such as for powering the tool 18, and, if desired, may also include a communication-system to communicate data between the tool 18 and the surface (not shown). In the particular embodiment shown, the downhole interface system 30 includes a telemetry mud pulser/turbo-alternator module 34 and a data acquisition/memory module 40. The mud pulser/turbo-alternator module 34 is capable of generating electricity from the flow of fluid entering the module 34 from the fluid delivery member 21, as is or becomes known. Referring to FIG. 2, the power generated in the telemetry mud pulser/turbo-alternator module 34 of this embodiment is transmitted to the data acquisition/memory module 40 via wires 38 and an electrical/data connection 39.

Referring again to FIG. 1, the exemplary downhole interface system 30 allows fluid to flow through the mud pulser/turbo-alternator module 34 and data acquisition/memory module 40. In the example shown in FIG. 2, the modules 34 and 40 include fluid pathways 36, 42, respectively, which are in fluid communication with one another. The flow of fluid is illustrated by arrow 48.

The exemplary mud pulser/turbo-alternator module 34 is also capable of communicating data to and from the surface (not shown). Referring to FIG. 2, the illustrated module 34 includes one or more mechanical and electronic components 37 capable of effecting communication with the surface. For example, the mechanical and electronic components 37 may include a modulator, modulator controller and/or printed circuit boards capable of "mud pulse" communication with the surface as is or becomes known. In such example, the measurement while drilling, "MWD", technology of Schlumberger Technology Corporation may be utilized as part of the module 34 to enable two-way telemetry. The illustrated module 34 is also equipped to communicate data with the data acquisition/memory module 40 through the wires 38 and electrical/data connection 39.

Still referring to FIG. 2, the exemplary data acquisition/memory module 40 includes electronic components 44 for transmitting and receiving data between the module 34 and the wireline tool 18, as is or becomes known. The illustrated data acquisition/memory module 40 also stores and processes information. The data acquisition/memory module 40 may be designed, for example, to store some or much of the information received from the tool 18, reducing the quantity of information that needs to be transmitted to the surface. If desired, for example, only the wireline tool status and basic data need be transmitted to the surface, while other data is stored in the data acquisition/memory module 40.

The downhole interface system 30 may include additional components and/or capabilities. For example, tension/compression load cells (not shown) may be included for quick detection of over-compression of the wireline tool 18. The present invention may also be designed so that such detection can be rapidly communicated to the surface, if desired.

Further details of the structure and operation of some examples of components that may be used as part of the downhole interface system 30 are described in U.S. Pat. Nos. 5,375,098; 5,249,161; and 5,237,540, each of which is incorporated herein by reference. However, the present invention is not limited to the details above, the use of a telemetry mud pulser/turbo-alternator module 34 or data acquisition/memory module 40, or the techniques or embodiments disclosed in the referenced patents.

The above description of exemplary components and the operation thereof is provided for illustrative purposes only and is not limiting upon the present invention. The present invention is thus not limited by the form, components and configuration of the tool conveying apparatus described above. Any components and techniques capable of generating power in the borehole for powering a wireline tool and, if desired, communicating data between the tool and the surface that are or become known may be used.

Figure 4:
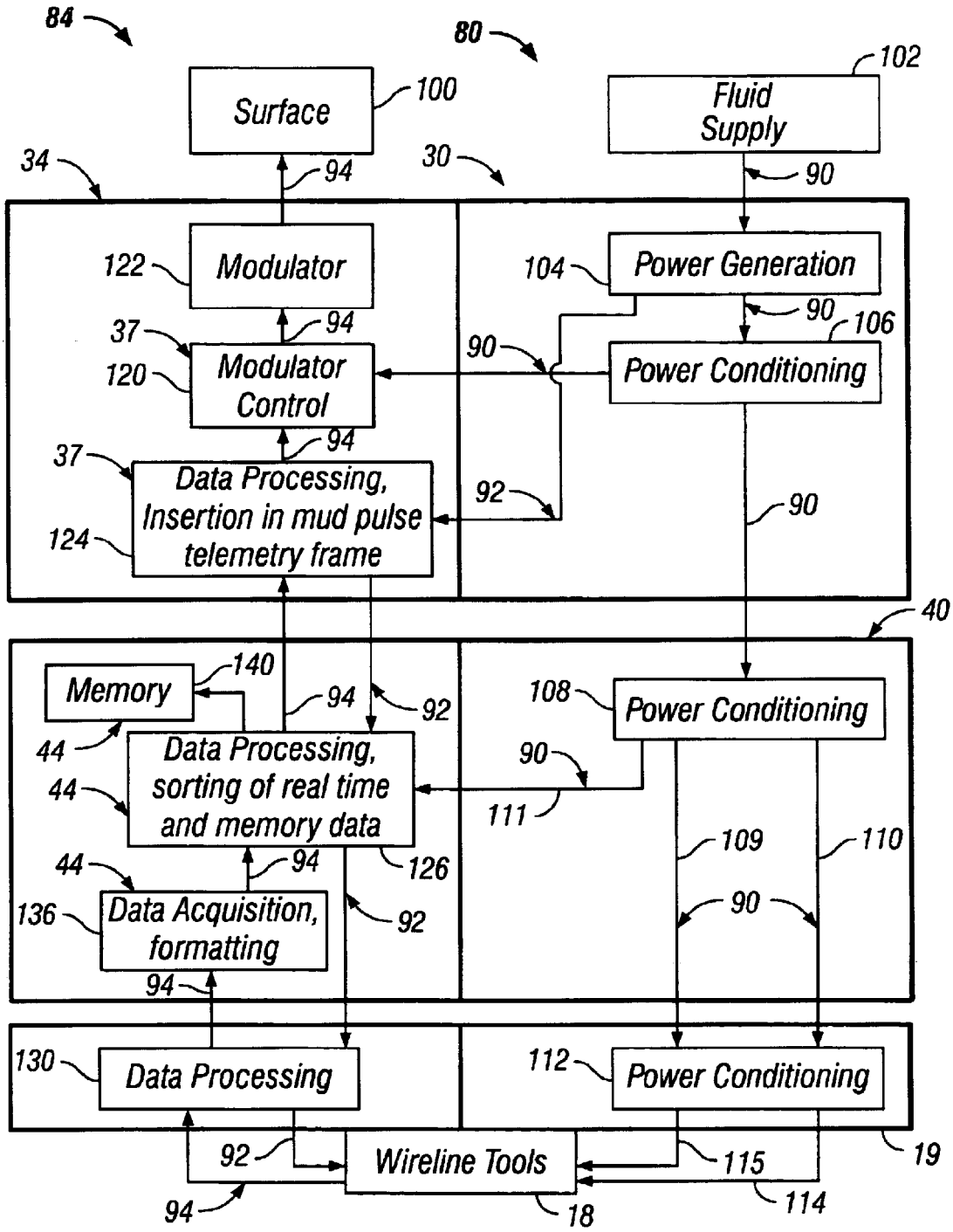
FIG. 4 is a flow diagram showing an embodiment of a method of operation of conveying a tool in a borehole in accordance with the present invention.

FIG. 4 is a flow diagram illustrating exemplary methods of power and data transmission involving a downhole tool in accordance with the present invention. The right hand side of the flow diagram, the "power" side 80 relates generally to the generation and transmission of power within a tool conveying apparatus of the present invention. The left hand side, the "data" side 84, relates generally to the receipt, processing, storage, generation and transmission of data (or any combination thereof) in a tool conveying apparatus of the present invention. Path 90 generally represents the transmission of power through the tool conveying apparatus, path 92 generally represents the transmission of data to a wireline tool or tools 18 carried by the tool conveying apparatus, and path 94 generally represents the transmission of data to the surface 100.

Referring initially to the power side 80 and power flow path 90, block 102 represents the supply of fluid through a fluid delivery member (e.g. through a fluid delivery member 21, FIG. 1) to a power generation system (block 104) of a downhole interface system (e.g. 30, FIG. 1). The power generation system 104, for example, may include a turbo-alternator capable of generating unregulated AC power from the fluid flow. In some embodiments, the frequency of the AC power generated by the turbo-alternator will depend upon the flow rate of the fluid into the turbo-alternator; e.g. the greater the flow rate, the higher the frequency of the AC power.

In the exemplary embodiment, the unregulated AC power is conditioned (block 106) for use in the tool conveying apparatus 10 and/or wireline tools 18. For example, one or more electronic circuits may be used to transform the unregulated AC power to regulated AC and/or DC power. In this embodiment, regulated DC power is provided to power a modulator controller (block 120) of the telemetry mud pulser/turbo-alternator module 34, and regulated AC power is provided to the data acquisition/memory module 40 at block 108.

Referring to block 108, the data acquisition/memory module 40 of this embodiment conditions and distributes the power it receives. For example, one or more electrical circuits may be used to provide high level AC power and high level DC power to a wireline telemetry sub 19 (if included), as indicated by arrows 109, 110, respectively, and low level DC power (arrow 111) may be provided to one or more electronic components 44 in the data acquisition/memory module 40.

The wireline telemetry sub 19, if included, may be equipped to condition power it receives (block 112) and/or distribute power to the wireline tool or tools 18, such as in the form of AC power and DC power (arrows 114, 115, respectively). The wireline tool or tools 18 use power received from the wireline telemetry sub 19 to perform their designated tasks, such as to record data from the borehole within which they are deployed.

Now referring to flow path 92 (the transmission of data to the wireline tool or tools 18) beginning at block 104, data about the fluid flow rate in the power generation device (block 104) of the illustrated embodiment is communicated to one or more electronic components 37, such as printed circuit boards, (block 124) of the telemetry mud pulser/turbo alternator module 34. If included, this capability may have any desired purpose. For example, when mud pulser technology is used, commands or instructions, such as requests for certain types of information to be obtained by the wireline tools, may be transmitted to the tool conveying apparatus from the surface by varying the flow rate of the fluid into the turbo-alternator, as is or becomes known. The power generation device (block 104) transmits such information to the electronic component(s) 37, such as circuitry, which translates, reads or processes the data received (block 124).

One or more electronic components 37 of the telemetry mud pulser/turbo-alternator module 34 of this embodiment transmits data to one or more electronic components 44 (block 126) of the data acquisition/memory module 40. The data transmitted, for example, may include instructions for the wireline tool that are provided via the flow rate information from the power generation device. The electronic component 44 evaluates, sorts, stores or processes the data, or any combination thereof (block 126). For example, the component 44 may convert wireline tool instructions received from the electronic component 37 to a digital command.

The electronic component 44 of the data acquisition/memory module 40 is capable of transmitting data, such as operational instructions, to one or more electronic components of the wireline telemetry sub 19, or directly to the wireline tool 18 if the sub 19 is not included. When a sub 19 is included, data may be processed therein (block 130) and transmitted to the tool 18, as is or becomes known.

Reference is now made to the flow path 94 (the transmission of data to the surface), beginning at the wireline tool 18. In the embodiment shown, information, such as digital data gathered by the wireline tool 18, is transmitted to one or more electronic components (block 130) of the wireline telemetry sub 19. The wireline telemetry sub 19 may evaluate, sort, store and/or process the data, and/or transmit data to the data acquisition/memory module 40 for formatting (block 136) and processing and/or sorting therein (block 126). If desired, some data may be stored in memory (block 140) therein, and some data may be transmitted to the telemetry mud pulser/turbo-alternator module 34. In the exemplary module 34, data received from the module 40 is processed (block 124) and transmitted to the surface (block 100) via the modulator controller (block 120) and modulator (block 122), as is or becomes known.

The present invention does not require each of the techniques or acts described above. Moreover, the present invention is in no way limited to the above methods of power generation, power and data transmission or other operations. Further, neither the methods described above nor any methods that may fall within the scope of any of the appended claims need be performed in any particular order. Yet further, the methods of the present invention do not require use of the particular embodiments shown and described in the present specification, such as, for example, the tool conveying apparatus 10 of FIG. 1, but are equally applicable with any other suitable structure, form and configuration of components.

Preferred embodiments of the present invention are thus well adapted to carry out one or more of the objects of the invention. The apparatus and methods of the present invention offer advantages over the prior art and additional capabilities, functions, methods, uses and applications that have not been specifically addressed herein but are, or will become, apparent from the description herein, the appended drawings and claims.

It should be understood that the present invention does not require all of the above features and aspects. Any one or more of the above features or aspects may be employed in any suitable configuration without inclusion of other such features or aspects. Further, while preferred embodiments of this invention have been shown and described, many variations, modifications and/or changes of the apparatus and methods of the present invention, such as in the components, details of construction and operation, arrangement of parts and/or methods of use, are possible, contemplated by the applicant, within the scope of the appended claims, and may be made and used by one of ordinary skill in the art without departing from the spirit or teachings of the invention and scope of the appended claims. All matter herein set forth or shown in the accompanying drawings should thus be interpreted as illustrative and not limiting.

Accordingly, the scope of the invention and the appended claims is not limited to the embodiments described and shown herein.

What is claimed is:

1. An apparatus for conveying at least one tool into a borehole from the surface, the apparatus in fluid communication with a fluid source and deployable in the borehole, the apparatus comprising:

a fluid delivery member;

a power generation system in fluid communication with said fluid delivery member; and a fluid discharge member in fluid communication with said power generation system and engageable with said at least one tool;

wherein fluid is provided to said power generation system through said fluid delivery member, utilized by said power generation system to generate power for powering said at least one tool, and discharged from the apparatus through said fluid discharge member.

2. The apparatus of claim 1, further comprising a communication system capable of transmitting data between the surface and said at least one tool without the necessity of a communication line from the surface.

3. The apparatus of claim 1, wherein said fluid discharge member is a circulating sub having at least one fluid discharge port and being capable of electrically and electronically connecting said power generation system and said at least one tool.

4. The apparatus of claim 1, wherein said power generation system includes a turbo-alternator capable of generating electricity from the flow of fluid through said power generation system.

5. The apparatus of claim 1, wherein said fluid delivery member is drill pipe, said drill pipe being controllably movable within the borehole, whereby said at least one tool is controllably deployable in the borehole.

6. The apparatus of claim 5, wherein the fluid is drilling mud.

7. The apparatus of claim 1, wherein said fluid delivery member is coiled tubing.

8. The apparatus of claim 1, wherein said fluid discharge member is integral with said power generation system.

9. The apparatus of claim 1, wherein said power generation system includes a telemetry mud pulser/turbo-alternator module and a data acquisition/memory module.

10. The apparatus of claim 9, wherein said telemetry mud pulser/turbo-alternator module transmits power and data to said data acquisition/memory module.

11. The apparatus of claim 9, wherein said telemetry mud pulser/turbo-alternator module and said data acquisition/memory module each include at least one fluid flow passageway, at least one said fluid flow passageway in said telemetry mud pulser/turbo-alternator module being in fluid communication with at least one said fluid flow passageway in said data acquisition/memory module.

12. The apparatus of claim 9, wherein said telemetry mud pulser/turbo-alternator module includes a modulator and modulator controller, and wherein said telemetry mud pulser/turbo-alternator module transmits data to the surface from said data acquisition/memory module.

13. The apparatus of claim 9, wherein said data acquisition/memory module transmits data between said telemetry mud pulser/turbo-alternator module and said at least one tool.

14. The apparatus of claim 1, wherein said fluid discharge member includes at least one discharge port, is connectable between said power generation system and a wireline telemetry sub, and is capable of electrically and electronically connecting said power generation system with said at least one tool.

15. The apparatus of claim 14, wherein said at least one tool is at least one wireline tool.

16. A tool conveying system for carrying at least one wireline tool and deploying the at least one wireline tool in a non-vertical or deviated borehole from the surface, the tool conveying system comprising:

a downhole interface system having at least one fluid passage extending therethrough;

a fluid circulation system having at least one fluid passage in fluid communication with said downhole interface system, said fluid circulation system enabling the flow of fluid through said downhole interface system; and wherein said downhole interface system is capable of generating power from the fluid flowing therethrough, providing power to said at least one wireline tool carried by the tool conveying system, and communicating data between said at least one wireline tool and the surface.

17. The tool conveying system of claim 16, wherein said downhole interface system is capable of generating electricity from the flow of fluid through said downhole interface system.

18. The tool conveying system of claim 16, wherein said downhole interface system is capable of communicating data between at least one wireline tool and the surface without the use of a wireline from the surface.

19. The tool conveying system of claim 18, wherein said downhole interface system includes a telemetry mud pulser/turbo-alternator module and a data acquisition/memory module.

20. A method for conveying at least one tool into a borehole from the surface using a tool conveying apparatus deployable in the borehole, the method comprising:

deploying the tool conveying apparatus in the borehole;

transmitting fluid through the tool conveying apparatus, the tool conveying apparatus generating power from the flow of fluid therethrough;

discharging fluid from the tool conveying apparatus; and wherein the tool conveying apparatus provides power to the at least one tool carried thereby.

21. The method of claim 20, wherein the tool conveying apparatus transmits data between said at least one tool carried thereby and the surface without the necessity of a communication line to the surface.

22. The method of claim 21, wherein a mud pulser is used to transmit data between said at least one tool and the surface.

23. The method of claim 22, wherein the tool conveying apparatus includes a turbo-alternator, and further includes the turbo-alternator generating unregulated AC power from the fluid flow through the tool conveying apparatus, and the tool conveying apparatus transforming unregulated AC power to at least one among regulated AC power and regulated DC power.

24. The method of claim 23, wherein the tool conveying apparatus includes a data acquisition/memory module, and further includes the data acquisition/memory module receiving power and data, storing data and distributing power and data to said at least one tool.

25. The method of claim 20, wherein the tool conveying apparatus includes a rigid upper member, and further comprises deploying the tool conveying apparatus into the borehole by moving the rigid upper member.

26. The method of claim 25, wherein the borehole is non-vertical or deviated and the fluid is drilling mud.

* * * * *